United States Patent [19]

Justiano et al.

[11] Patent Number: 4,740,173

[45] Date of Patent: Apr. 26, 1988

[54] CONNECTOR FOR AN ELECTRIC RANGE

[76] Inventors: Joseph G. Justiano, 267 10th St., Bethpage, N.Y. 11714; Wolfgang F. Bienwald, 11 Culver Ct., Melville, N.Y. 11746

[21] Appl. No.: 16,298

[22] Filed: Feb. 19, 1987

Related U.S. Application Data

[63] Continuation of Ser. No. 774,101, Sep. 11, 1985, abandoned.

[51] Int. Cl.[4] ..... H01R 13/432

[52] U.S. Cl. ..... 439/351; 439/357; 439/744; 439/856

[58] Field of Search ..... 339/91 R, 258 R, 258 P, 339/217 S; 219/451, 455, 463; 439/350–359, 744, 856

[56] References Cited

U.S. PATENT DOCUMENTS

| | | | |
|---|---|---|---|
| 1,841,736 | 1/1932 | Jones | 339/217 S |
| 2,762,026 | 9/1956 | Knohl | 339/217 S |
| 3,184,580 | 5/1965 | Hanson | 339/91 R |
| 3,188,600 | 6/1965 | Woofter et al. | 339/91 R |
| 3,200,237 | 8/1965 | Hanson | 219/451 |
| 3,327,095 | 6/1967 | Hanson | 219/451 |
| 3,750,092 | 7/1973 | Bury | 339/217 S |
| 4,117,310 | 9/1978 | Clark | 219/451 |

*Primary Examiner*—John McQuade

[57] ABSTRACT

The invention features an insulative contact locking device for an electric range. When the heating coils of the range are caused to experience many heat cycles, the constant expansion and contraction of the heating terminals often causes a loosening of the power contacts. The invention comprises a pair of spring-biased contacts that positively hold the terminal ends in secure mechanical and electrical contact with the power wires.

4 Claims, 3 Drawing Sheets

CONNECTOR FOR AN ELECTRIC RANGE

CROSS REFERENCE TO RELATED APPLICATIONS

This application is a continuation of patent application Ser. No. 774,101, filed Sept. 11, 1985, now abandoned.

FIELD OF THE INVENTION

The invention relates to a power connector for electrical heating elements of an electric range, and more particularly to an improved power connector that will remain positively connected during the heating cycles of the electric range.

BACKGROUND OF THE INVENTION

A problem frequently experienced with connective elements of electric stoves or ranges, is the compression or expansion of the electrical contacts as the heating elements are subjected to an operative heating cycle. The connective elements between the power wires and heating coils of the range often experience thermal wear and deterioration due to the cyclic heating of the coils.

Very often, these contacts loosen with respect to the coil and become inoperative in supplying power to the coil.

The present invention features a new connector design that positively fastens and locks the terminal ends of the heating coil elements to the source of the power.

The connectors of the invention are shaped like a butterfly, and spread within the insulative housing as the terminal ends of the heating coil element are inserted upon assembly between the leaves of the butterfly section. The spreading butterfly leaves abut against internal wall abuts, thus causing a positive locking action to result with respect to the inserted terminal ends of the heating coil.

SUMMARY OF THE INVENTION

The invention features a device for insulating and connecting a pair of power wires and the terminal ends of an electric range heating element.

The device comprises a pair of spring-like contacts that connect, each to one of the power wires. The contacts each have a butterfly section for receiving the terminal end of a heating element. The butterfly sections each terminate on one end thereof in a pair of flared lips, and have on an opposite end a pair of outwardly projecting tines.

An insulative body has two channels that extend substantially parallel to each other. Each channel receives at one end the spring-like contacts and at an opposite end the terminal ends of the heating element. The channel has an undercut portion for receiving the spring-like contact in locking engagement. The undercut portion terminates in forward abutments and the channel further includes abutments near its contact-receiving end for limiting the forward movement of the contact by engaging with bent tabs on the contacts, and rearward abutments for limiting the rearward movement of the contact by engaging with each of said projecting tines.

When the terminal ends of the heating element are inserted into the respective butterfly sections, they will cause the sections to spread. The lips and tines abut against their respective abutments, such that lateral movement of the terminal ends are prevented within the body.

A stand is also provided for the insulative body. The stand holds the body separated from the internal range platform. The stand has a pair of prongs that engage a bracket located on terminal ends of the heating element. The stand is affixed to the insulative body by means of apertures in the sides of the insulative body.

It is an object of the invention to provide an improved means for attaching power wires to electric heating coils of an electric range.

It is another object of this invention to provide a connection between power wires and a heating element of an electric range that will remain positively connected during the heat cycling.

BRIEF DESCRIPTION OF THE DRAWINGS

FIG. 6 is a rear perspective view of the insulative body of the invention, showing two different internal, and an external abutment.

DETAILED DESCRIPTION OF THE DRAWINGS

Generally speaking, the invention pertains to a connective device that affixes power wires to the terminal ends of an electric range heating coil. The device insulates the connection by surrounding the connection with an insulative body. The body acts to hold the connection in a positively biased state, so that the connection will not loosen despite repeated heating cycles featuring alternating expansion and contraction conditions.

Figures 1, 1A, 1B:
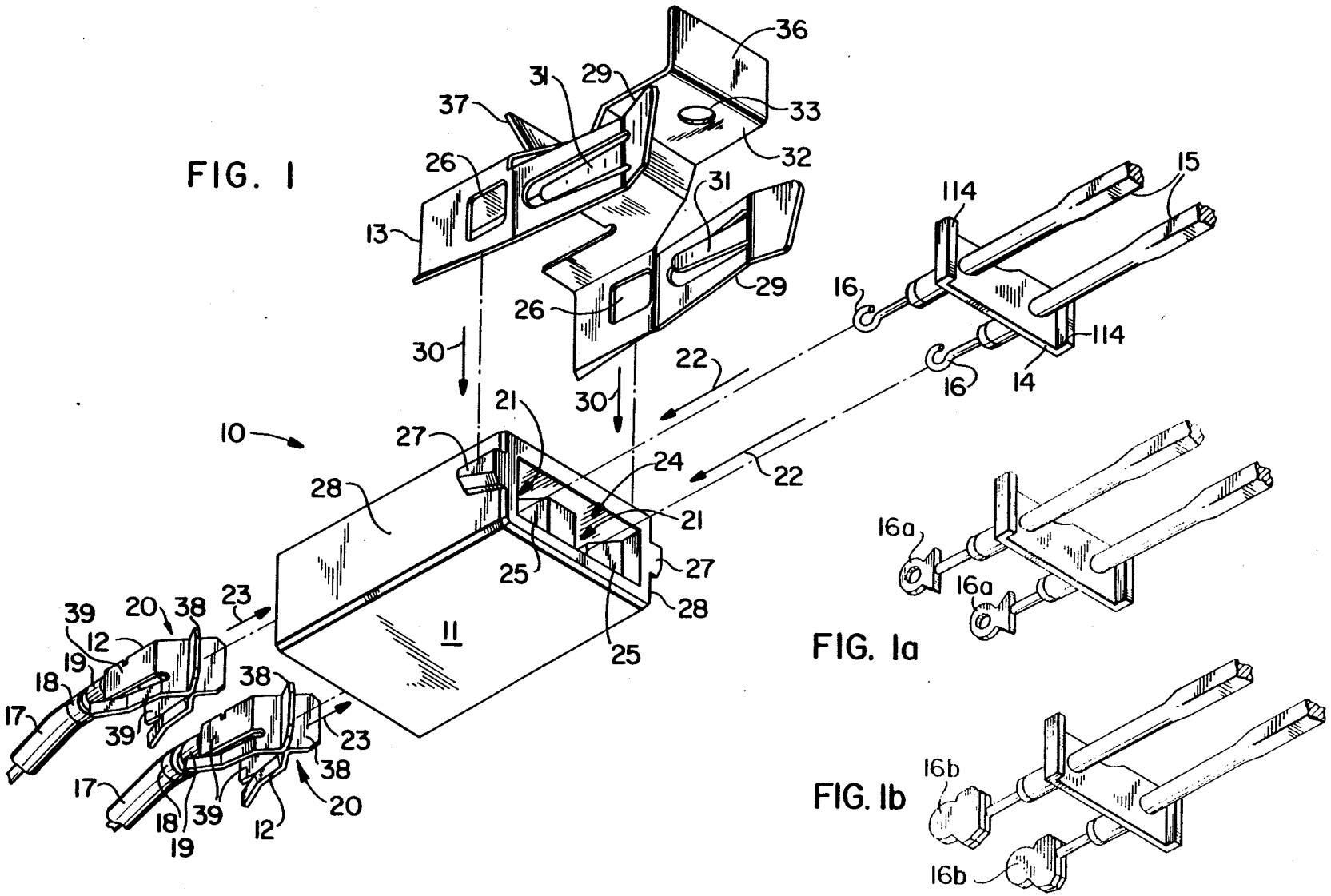
FIG. 1 is an exploded perspective view of the connection device of this invention.
FIGS. 1*a* and 1*b* are alternate embodiments of the terminal ends of a heating coil, each capable of being utilized in the invention illustrated in FIG. 1.
Figure 2:
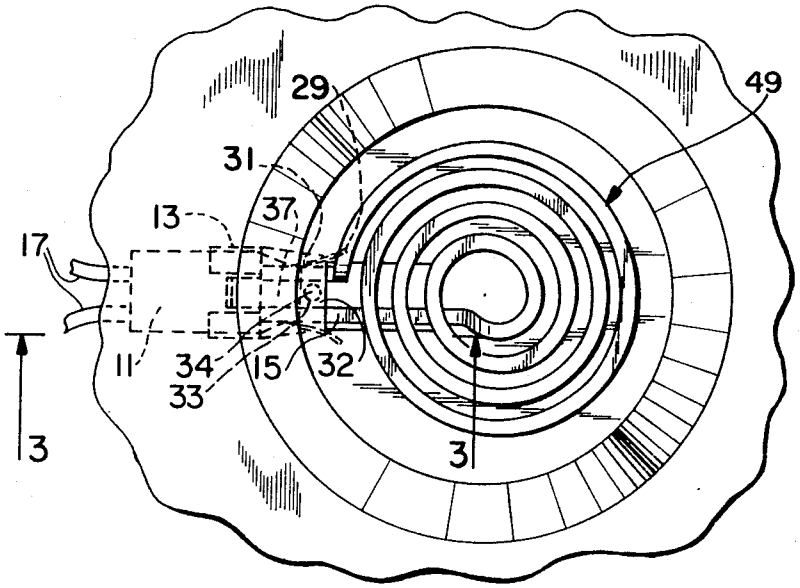
FIG. 2 is a plan view of the inventive device of FIG. 1, depicted in situ with a range heating coil element.

Now referring to FIG. 1, the connection device 10 of this invention is shown in an unassembled view. The device 10 is comprised of an insulative porcelain body 11, a pair of spring-like contacts 12, a metal stand 13, and a bracket 14 holding the terminal ends 15 of range heating elements 49 (FIG. 2).

For purposes of brevity and clarity, like elements will have the same numerical designation throughout the figures. One of the objects of the device 10 is to connect the power wires 17 with the terminal ends 15 of the heating elements 49 in a positive, self-locking fashion.

The power wires 17 are each crimped to respective like contacts 12, by crimping tabs 18 and 19. Tab 18 affixes the insulation portion of wire 17 in a mechanical bond, while tab 19 affixes the internal copper wire electrically. Tab 19 is soldered to provide positive electrical and mechanical contact.

Contacts 12 are shaped like a butterfly about a mid-section 20. This mid-section 20 receives the hooks 16 of the terminal ends 15 of range heating element 49, as will be described in more detail, hereinafter.

The contacts and the hook ends 16 are insulatively shielded by the porcelain body 11. The body 11 has two internal channels 21 for receiving (arrows 22) hooks 16. The contacts 12 are inserted into the channels 21 (arrows 23) from the rear of body 11. The front of body 11 has a rectangular opening 24 into which the bracket 14 fits as the hook ends 16 are inserted. Bracket 14 has flanges 114 that engage with tabs 31 of extensions 29 to lock the bracket 14 in the opening. The channels have chamfered surfaces 25 to assist the introduction of the hooks 16 in channels 21.

The stand 13 has two side apertures 26 that snap fit over (arrows 30) the abutments 27 that project from the sides 28 of body 11. The stand 13 has two forward extensions 29 that receive bracket 14. Two inwardly projecting tabs 31 are biased toward terminal ends 15.

The center section 32 of the stand 13 has a hole 33 that receives a pin 34 (FIG. 3) for affixing the stand 13 to the range platform 35.

Figure 3:
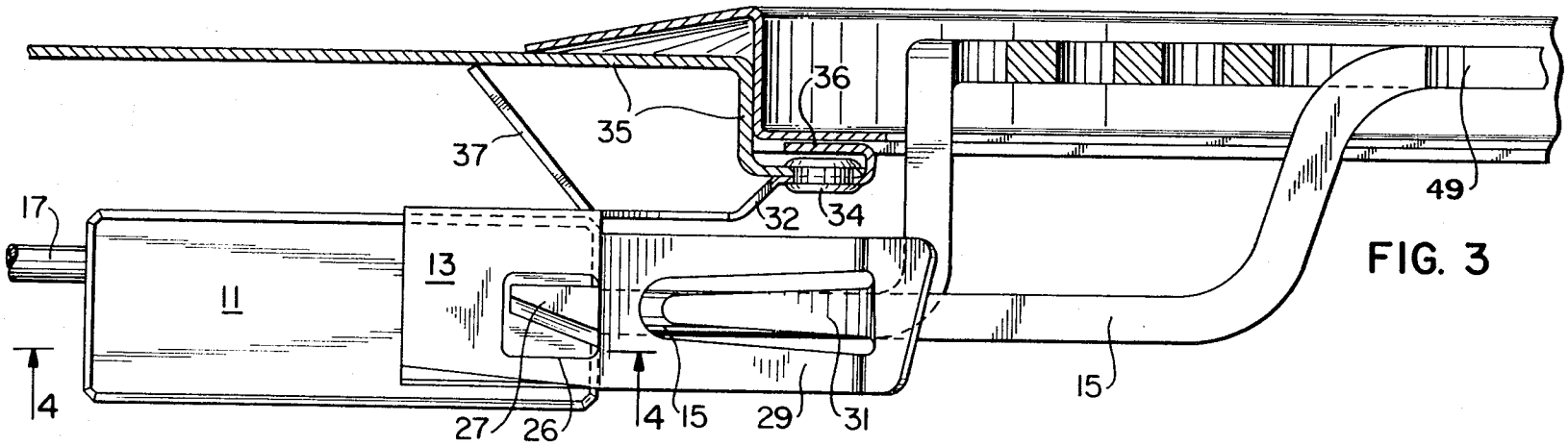
FIG. 3 is a sectional, enlarged view of the device taken along lines 3—3 of FIG. 2.

The front lip 36 is bent over and under pin 34, as shown in FIG. 3. The rear leg 37 holds the stand 13 and body 11 separated from range platform 35. An over-all plan view of this assembly is illustrated in FIG. 2.

Referring to FIGS. 1*a* and 1*b* two alternate embodiments for hook ends 16 of FIG. 1, are shown. FIG. 1*a* illustrates hook ends 16*a* that feature closed loop ends. FIG. 1*b* depicts hook ends 16*b* that are solid tabs. Each of these hook ends 16, 16*a* or 16*b* can be used in the apparatus of FIG. 1.

Figure 4:
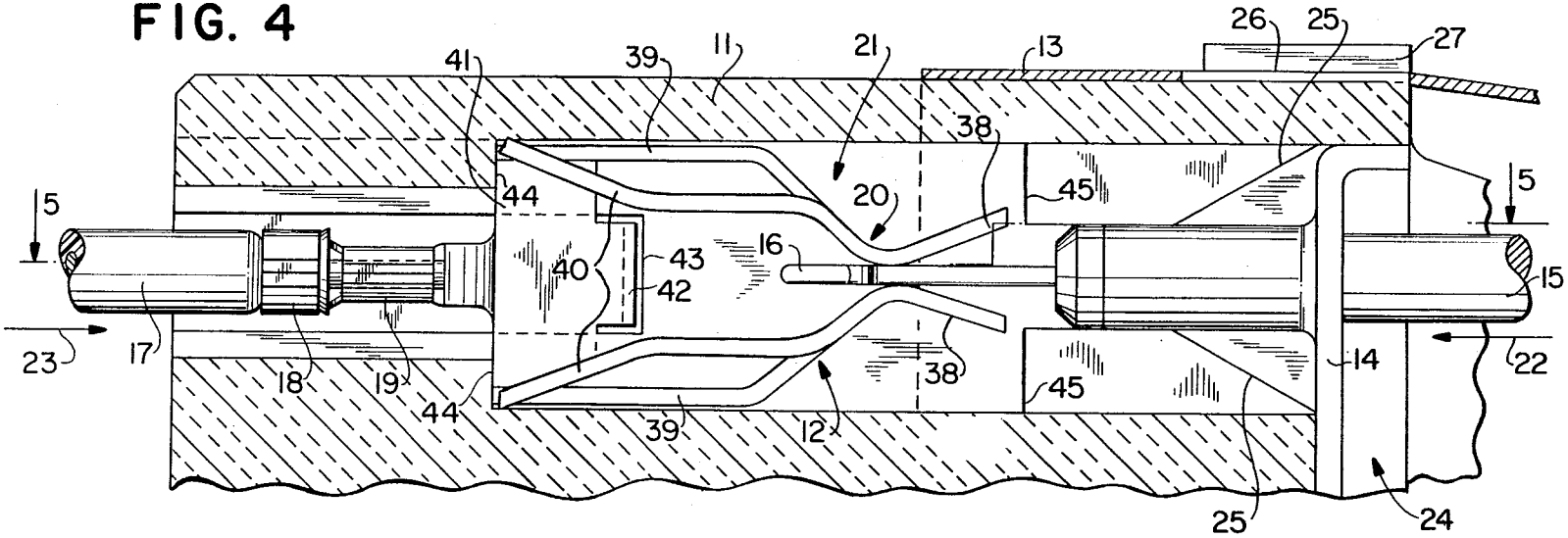
FIG. 4 is a sectional view of the device shown in FIG. 3, taken along lines 4—4; the connector of the device is shown as assembled, with terminals installed.
Figure 5:
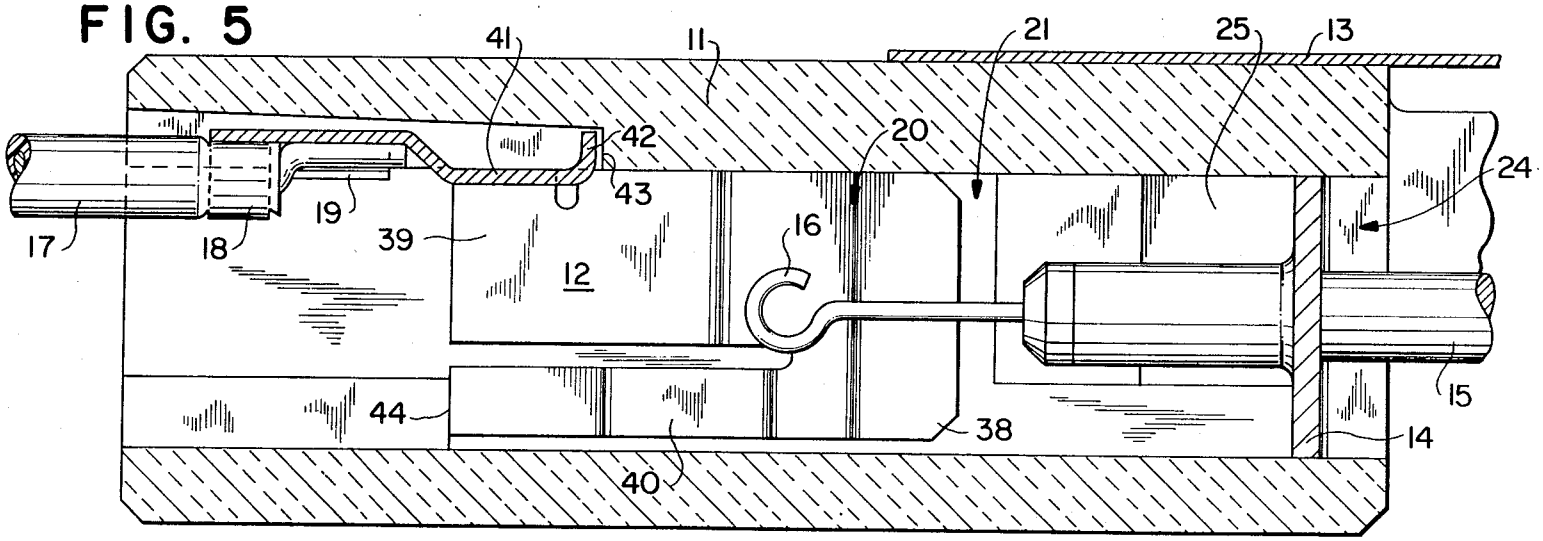
FIG. 5 is a sectional view of FIG. 4 taken along lines 5—5.

The contacts 12 are inserted through the rear section of body 11, as aforementioned, and snap fit into channels 21, as more clearly illustrated in FIGS. 4 and 5.

The contacts 12 have flared lips 38 at the front of butterfly section 20, and rear legs 39 that extend straight back from mid-section 20. Two projecting tines 40 extend from the rear of the contacts 12. A bottom section 41 of contact 12 has a bent tab 42 that abuts against abutment 43 shown in perspective in FIG. 6, and prevents further forward movement of contact 12, after contact 12 is inserted (arrow 23) in channel 21. In the inserted position, rearward movement of contact 12 is limited by tines 40 which abut against internal abutments 44.

Contacts 12 located within the channels of body 11 include tines 40 which are spring biased against the inner surface of the body, having been temporarily compressed inward during insertion of the contacts into the channels.

In the inserted position, flared lips 38 are open sufficiently to receive inserted hook ends 16, which pass the butterfly mid-section 20. Hook ends 16 force lips 38 to further separate. Upon attempted forward or rearward movement of contact 12, bent tab 42 is stopped by abutment 43, and tine 40 is stopped by abutment 44. Any overriding forward movement of the terminal is stopped by abutment 45.

The contact 12 is, thus, biased into locking contact within body 11. In this spring-biased state, the contact 12 clamps upon inserted hook end 16, thereby insuring that the terminal ends 15 will always be in positive mechanical and electrical contact with the power wires 17 despite expansion or contraction due to the heating cycle of the heating element 16.

In other words, the insertion of a hook end 16 past the butterfly mid-section 20 causes a spring tension in the contact 12, whereby the hook end 16 is caused to be held firmly by opposite and equal forces exerted upon it by the contact and the internal abutments within body 11.

Having thus described the invention, what is desired to be protected by Letters Patent is presented in the subsequently appended claims.

What is claimed is:

1. A device for insulating and connecting a pair of power wires and the terminal ends of an electric range heating element, said device comprising:

a pair of spring-like contacts, each connected to one of said pair of power wires and each having means defining a butterfly section for receiving an inserted one of said terminal ends of said heating element, said butterfly sections terminating on one end thereof in a pair of flared lips and having on an opposite end thereof a pair of outwardly projecting tines; and an insulative body having a front end and a rear end, and means defining two channels therethrough, extending substantially parallel to each other, each channel for receiving at a rear end thereof one of said spring-like contacts, and at a front end thereof one of said terminal ends of said heating elements, each channel having an internal portion for receiving one of said spring-like contacts in locking engagement, each internal portion having a first forward abutment, located at said channels' front end, for limiting forward movement of said spring-like contacts by engaging with each of said flared lips, and having rearward abutments for limiting rearward movement of said spring-like contacts by engaging with each of said projecting tines, whereby said respective butterfly sections will be caused to spread upon insertion of said terminal ends, and clamp upon them, a spring-like stand attached to the front end of said insulative body for holding said insulative body separated from a platform of the electric range, a mounting bracket attached to said heating element terminal ends for holding them in spaced-apart relationship, said insulating body's channels terminating in an opening for receiving said mounting bracket, and wherein said bracket acts to close said opening.

2. The device of claim 1, further comprising:

said spring-like stand having wall portions generally parallel to said channels and extending beyond the front end of said insulative body, one of said wall portions including a rearwardly extending tab, biased toward a terminal of said heating elements, and ending just forward of the insulative body's front end, said tab of said stand depending forward of, and below an outer edge of said mounting bracket when said terminal ends are inserted into said channels, so that removal of said terminal ends from said insulative body is obstructed after insertion.

3. The device of claim 2, further comprising:

said mounting bracket including a flange at an edge for engaging with said tab of said stand.

4. A device for insulating and connecting a pair of power wires and the terminal ends of an electric range heating element, comprising:

a pair of spring-like contacts, each connected to one of said pair of power wires and each having means defining a butterfly section for receiving an inserted one of said terminal ends of said heating element, said buttefly sections terminating on one end thereof in a pair of flared lips and having on an opposite end thereof a pair of outwardly projecting tines; and an insulative body having a front end and a rear end, and means defining two channels therethrough, extending substantially parallel to each other, each channel for receiving at a rear end thereof one of said spring-like contacts, and at a front end thereof one of said terminal ends of said heating elements, each channel having an internal portion for receiving one of said spring-like contacts in locking engagement, each internal portion having a first forward abutment, located at said channels' front end, for limiting forward movement of said spring-like contacts by engaging with each of said flared lips, and having rearward abutments for limiting rearward movement of said spring-like contacts by engaging with each of said projecting tines, whereby said respective butterfly sections will be caused to spread upon insertion of said terminal ends, and clamp upon them, a spring-like stand attached to the front end of said insulative body for holding said insulative body separated from a platform of the electric range, said spring-like stand having wall portions generally parallel to said channels and extending beyond the front end of said insulative body, one of said wall portions including a rearwardly extending tab, biased toward a terminal of said heating elements, and ending just forward of the insulative body's front end, a mounting bracket attached to said heating element terminal ends for holding them in spaced-apart relationship, a tab, located on each spring-like contact, between its connection to the power wire and its butterfly section, perpendicular to the clamping butterfly sections, and extending perpendicular to and across the channel direction, a groove in each channel, commencing at its rear end and terminating in a second forward abutment for receiving said perpendicular tab, said second forward abutment being for limiting forward movement of the spring-like contact.

* * * * *